US009304458B2

(12) United States Patent
Hara et al.

(10) Patent No.: US 9,304,458 B2
(45) Date of Patent: Apr. 5, 2016

(54) IMAGE FORMING APPARATUS

(71) Applicant: CANON KABUSHIKI KAISHA, Tokyo (JP)

(72) Inventors: Jun Hara, Kawasaki (JP); Tomoo Akizuki, Yokohama (JP); Masahiko Suzumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/491,020

(22) Filed: Sep. 19, 2014

(65) Prior Publication Data

US 2015/0086250 A1 Mar. 26, 2015

(30) Foreign Application Priority Data

Sep. 20, 2013 (JP) ..... 2013-195823
Aug. 5, 2014 (JP) ..... 2014-159898

(51) Int. Cl.
*G03G 15/20* (2006.01)

(52) U.S. Cl.
CPC ..... *G03G 15/2053* (2013.01); *G03G 15/206* (2013.01)

(58) Field of Classification Search
USPC ..... 399/322
See application file for complete search history.

(56) References Cited

U.S. PATENT DOCUMENTS

| | | | |
|---|---|---|---|
| 7,177,579 | B2 | 2/2007 | Uchida et al. |
| 7,283,763 | B2 | 10/2007 | Akizuki et al. |
| 7,389,079 | B2 | 6/2008 | Narahara et al. |
| 7,512,370 | B2 | 3/2009 | Shimizu et al. |
| 8,811,872 | B2 | 8/2014 | Nakagawa et al. |
| 2011/0091236 | A1 | 4/2011 | Oi et al. |
| 2012/0243894 | A1 | 9/2012 | Umeda et al. |

FOREIGN PATENT DOCUMENTS

| | | | |
|---|---|---|---|
| JP | 2006195003 | A | 7/2006 |
| JP | 2010164636 | A | 7/2010 |
| JP | 2011085866 | A | 4/2011 |

OTHER PUBLICATIONS

U.S. Appl. No. 14/482,163, filed Sep. 10, 2014.

*Primary Examiner* — Minh Phan
(74) *Attorney, Agent, or Firm* — Fitzpatrick, Cella, Harper & Scinto

(57) ABSTRACT

An image forming apparatus includes an image bearing member; a transfer unit for transferring a toner image from the image bearing member onto the recording material; a fixing unit for fixing the toner image on the recording material; an electroconductive member contactable to the recording material; a resistance element connected with the electroconductive member; and a capacitor element connected with the electroconductive member. The electroconductive member is disposed so as to be nipped simultaneously by the transfer nip and the fixing nip and so as to be contacted by the recording material, and the electroconductive member and the capacitor element are connected in parallel between the electroconductive member and a ground potential.

12 Claims, 10 Drawing Sheets

IMAGE FORMING APPARATUS

FIELD OF THE INVENTION AND RELATED ART

The present invention relates to an image forming apparatus such as a copying machine, a printer, a facsimile machine, etc., which uses an electrophotographic image forming method or electrophotographic recording method.

In the case of an electrophotographic image forming apparatus, first, its photosensitive component is uniformly charged across its peripheral surface. Then, the uniformly charged portion of the peripheral surface is exposed according to the information of an image to be formed. Thus, an electrostatic latent image is effected on the peripheral surface of the photosensitive component. This electrostatic latent image is developed into a toner image, with the use of toner. Then, the toner image is directly transferred onto a sheet of a recording medium, such a sheet of paper, or indirectly transferred onto a sheet of a recording medium by way of an intermediary transfer component, by a transfer unit. After the transfer of the toner image onto a sheet of the recording medium, the toner image is thermally fixed to the sheet of the recording medium by a fixation unit. Generally speaking, a transfer unit forms a transfer nip between itself and an image bearing component or an intermediary transfer component, through which the sheet of the recording medium, on which the toner image is present, is conveyed while remaining pinched between the transfer unit and image bearing component. While the sheet P is conveyed through the transfer nip, a transfer voltage is applied to the transfer nip, whereby the toner image is transferred onto the sheet of the recording medium. Also generally speaking, the fixation unit has a heating component provided with a heat source, and a pressure applying component which forms a fixation nip between itself and the fixation unit, which is being pressed (or kept pressed) upon the heating component. After being conveyed through the transfer nip, the sheet P of the recording medium is conveyed through the fixation nip, while remaining pinched by the heating component and the pressure applying component, and being subjected to the heat from the heating component. Consequently, the toner image becomes fixed to the sheet P.

Some fixation units have a heat generating resistor as a heat source. They thermally fix the toner image on a sheet of a recording medium to the sheet with the use of the heat generated by supplying electric power to the heat generating resistor. The amount by which electric power is supplied to the heat source is controlled based on the temperature level detected by a temperature detection element. As for a method for supplying the heat source with electric power, there are a method which uses AC voltage supplied by a commercial power source, without rectifying the AC voltage, and a method which rectifies the AC voltage to supply the heat source with DC voltage. Generally speaking, a method which supplies the heat source with the electric power from a commercial power source does not require a rectifying circuit. Therefore, it can reduce a fixation unit in cost.

In a case where AC voltage is applied to a heat source, a layer of glass, with which the heat generating component on the substrate of the heat source is coated, functions like a capacitor in an equivalent circuit. In this case, therefore, AC voltage is applied to the fixation nip through a fixation film, for example, which functions as the heating component.

A recording medium which is high in a coefficient of water absorption is likely to decrease in impedance while it is left unattended. In particular, when a sheet of paper left unattended for a substantial length time in a high temperature-high humidity ambience is used as a recording medium, the AC voltage applied to the fixation nip travels to the transfer nip through the recording medium. Thus, the transfer current becomes excessive or insufficient in synchronism with the oscillatory frequency of this AC voltage. Thus, it sometimes occurs that the transferred image displays non-uniformity in density (this image may hereafter be referred to as "AC banding image"). That is, an image forming apparatus structured so that AC voltage is applied to the recording medium sometimes outputs AC banding images.

In comparison, the fixation unit disclosed in Japanese Laid-open Patent Application 2006-195003 is grounded through a capacitor. More specifically, a capacitor which is greater in capacitance than the glass coating of the heater is placed between the fixation nip and the ground. In the case of this design, if a voltage surge occurs in a common mode to a commercial power source due to lightening or the like, a major portion of this voltage surge is borne by the glass coating. This does not create any problem as long as the fixation unit is provided with a surge protection circuit and/or the glass coating can withstand high voltage such as the surface voltage attributable to lightening. However, if the fixation unit is not provided with a protection circuit, and also, the glass coating cannot withstand high voltage, it is possible that the glass coating will be damaged.

In the case of the method, disclosed in Japanese Laid-open Patent Application 2006-195003, for preventing the glass coating from being damaged, a resistor is placed in series between the fixation nip and ground.

However, in a case where a resistor is placed in series as described above, the presence of a capacitor reduces the AC voltage in coefficient of attenuation. Thus, even if the capacitor is increased in capacitance, it is sometimes impossible to satisfactorily prevent the occurrence of AC banding images.

SUMMARY OF THE INVENTION

Thus, the primary object of the present invention is to provide an image forming apparatus capable of more effectively controlling the transfer voltage fluctuation attributable to the application of AC voltage to the fixation unit than a conventional image forming apparatus.

According to an aspect of the present invention, there is provided an image forming apparatus comprising an image bearing member for carrying a toner image; a transfer unit for nipping a recording material by a transfer nip formed with the image bearing member and for transferring the toner image from the image bearing member onto the recording material; a fixing unit for nipping the recording material by a fixing nip and for fixing the toner image on the recording material by heating the recording material using an AC voltage applied thereto; a voltage source portion for applying an AC voltage to the fixing unit; an electroconductive member contactable to the recording material; a resistance element connected with the electroconductive member; and a capacitor element connected with the electroconductive member. The electroconductive member is disposed so as to be nipped simultaneously by the transfer nip and the fixing nip and so as to be contacted by the recording material, and the electroconductive member and the capacitor element are connected in parallel between the electroconductive member and a ground potential.

Further features of the present invention will become apparent from the following description of exemplary embodiments (with reference to the attached drawings).

DESCRIPTION OF THE PREFERRED EMBODIMENTS

Hereinafter, image forming apparatuses in accordance with the present invention are described in detail with reference to appended drawings.

[Embodiment 1]

1. Overall Structure and Operation of Image Forming Apparatus.

Figure 1:
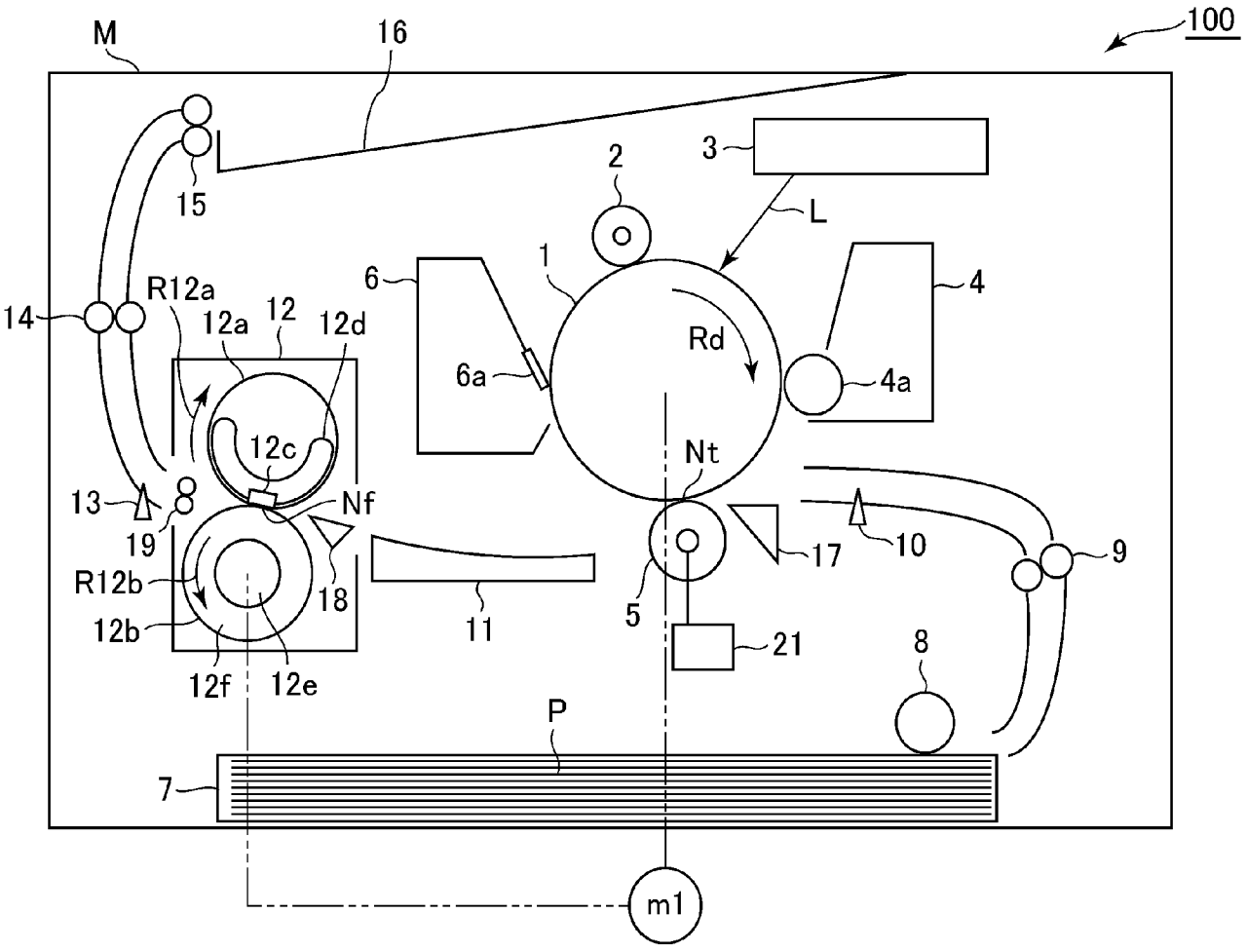
FIG. 1 is a schematic vertical sectional view of a typical image forming apparatus to which the present invention is applicable.

FIG. 1 is a schematic vertical sectional view of the image forming apparatus in the first embodiment of the present invention. The image forming apparatus 100 in this embodiment is a laser printer which uses an electrophotographic image forming method.

The image forming apparatus 100 has a photosensitive drum 1, which is a photosensitive component, as an image bearing component, which is in the form of a drum (cylindrical drum). The photosensitive drum 1 has a cylindrical substrate formed of aluminum, nickel, or the like, and a photosensitive layer formed of such a photosensitive substance as OPC (organic semiconductor) amorphous selenium, and amorphous silicon, on the peripheral surface of the cylindrical substrate. The photosensitive drum 1 is rotatably supported by the main assembly M of the image forming apparatus 100, and is rotationally driven by a driving force source m1 in the direction indicated by an arrow mark Rd in the drawing, at a process speed of 230 mm/sec. In this embodiment, the photosensitive drum 1 is 24 mm in external diameter.

There are sequentially disposed the following units in the rotational direction of the photosensitive drum 1, in the adjacencies of the peripheral surface of the photosensitive drum 1. The first unit is a charge roller 2 which is a roller-shaped charging member of a charging unit. The next is an exposing device (laser scanner) as an exposing member of an exposing unit. The next is a developing device 4 as a developing unit. The next is a transfer roller 5 which is a roller-shaped transferring member of a transfer unit. The transfer roller 5 is an example of the transfer unit component, which holds a sheet P of the recording medium between itself and photosensitive drum 1, and also, transfers the toner image on the peripheral surface of the photosensitive drum 1 as voltage is applied to the transfer roller 5. The next is a cleaning device 6 as a cleaning unit.

There is disposed a recording medium cassette 7, in the portion of the apparatus main assembly M, which corresponds to the bottom portion of the drawing. The recording medium cassette 7 can store multiple sheets P of a recording medium such as paper. Further, there are sequentially disposed a feed roller 8, a conveyance roller 9, a top sensor 10, a pre-transfer guide 17, a conveyance guide 11, a fixation unit 12, a discharge sensor 13, a conveyance roller 14, a discharge roller 15, and a delivery tray 16, along the passage through which each sheet P of the recording medium is conveyed. The fixation unit 12 is provided with an entrance guide 18 and a pair of exit rollers, as will be described layer in detail.

Next, the image forming operation of the image forming apparatus 100 is described. The photosensitive drum 1 is rotationally driven by the driving force source m1 in the direction indicated by the arrow mark Rd in the drawing. As the photosensitive drum 1 is rotated, its peripheral surface is roughly uniformly charged by the charge roller 2 to a preset polarity (negative in this embodiment) and potential level. During this process, charge bias (charge voltage) is applied to the charge roller 2 from an unshown charge voltage source (high voltage power source). The charged portion of the peripheral surface of the photosensitive drum 1 is exposed to a beam L of light modulated according to the information of an image to be formed. As a given point of the uniformly charged portion of the peripheral surface of the photosensitive drum 1 is exposed to the beam L of light, it is reduced in electrical charge. Consequently, an electrostatic latent image (electrostatic image) is effected on the peripheral surface of the photosensitive drum 1. This electrostatic latent image on the peripheral surface of the photosensitive drum 1 is developed into a toner image by the developing device 4. The developing device 4 has a development roller 4*a*, as a developer bearing component, which supplies the area of virtual contact between the photosensitive drum 1 and development roller 4*a*, with toner (developer). As development bias (development voltage) is applied to the development roller 4*a*from an unshown development voltage source, toner is adhered to the electrostatic latent image on the photosensitive drum 1; the electrostatic latent image is developed into a toner image. In this embodiment, a toner image is formed by a reversal development method, that is, a developing method which adheres toner having been charged to the same polarity as the peripheral surface of the photosensitive drum 1, to the exposed points of the peripheral surface of the photosensitive drum 1, that is, the points having been charged to the preset level, and then, reduced in potential level (absolute value) by being exposed thereafter.

After a toner image is formed on the peripheral surface of the photosensitive drum 1, the toner image is transferred onto a sheet P of the recording medium such as paper, by the function of the transfer roller 5. The transfer roller 5 is kept pressed upon the peripheral surface of the photosensitive drum 1 by the pressure generated by compression springs (unshown) in the direction to press the transfer roller 5 toward the photosensitive drum 1. Thus, a transfer nip Nt is formed between the photosensitive drum 1 and transfer roller 5. That is, the area of contact between the photosensitive drum 1 and transfer roller 5 is the transfer nip Nt. The transfer roller 5 is rotated by the rotation of the photosensitive drum 1. In this embodiment, the external diameter of the transfer roller 5 is 12.5 mm. The transfer roller 5 sandwiches (pinches) a sheet P of the recording medium between itself and photosensitive drum 1, and conveys the sheet P through the fixation nip Nt, in coordination with the photosensitive drum 1. During the conveyance of the sheet P through the transfer nip Nt, transfer voltage is applied to the transfer roller 5 from a transfer voltage source (high voltage source) 21. The transfer voltage is DC voltage, and is opposite in polarity from the toner polarity (intrinsic toner charge polarity) during the development process. Thus, the toner image on the photosensitive drum 1 is transferred onto a predetermined area of the sheet P.

The recording medium cassette 7 can store a substantial number of sheets P of the recording medium. The sheets P in the cassette 7 are moved out of the cassette 7 by a sheet feeder roller 8 one by one. Then, each sheet P is conveyed by a pair of conveyance rollers 9 to the transfer nip Nt, while being guided by the pre-transfer guide 17 as a sheet guiding component. While the sheet P is conveyed along the pre-transfer guide 17, its leading edge is detected by the top sensor 10 so that the arrival of the sheet P at the transfer nip Nt will synchronizes with the arrival of the toner image on the photosensitive drum 1 at the transfer nip Nt.

After the toner image is transferred onto the surface of the sheet P, the sheet P is conveyed to the fixation unit 12 along the conveyance guide 11. In the fixation unit, the unfixed toner image on the sheet P is subjected to heat and pressure. Consequently, the unfixed toner image becomes fixed to the surface of the sheet P. The detailed description of the fixation unit 12 will be given later.

After the toner image is fixed to the sheet P of the recording medium by the fixation unit 12, the sheet P is conveyed further by the pair of conveyance rollers 14, and is discharged by the pair of conveyance rollers 15 into the delivery tray 16, which is a part of the top wall of the apparatus main assembly M shown in FIG. 1. During this conveyance of the sheet P from the fixation unit 12 to the delivery tray 16, the trailing edge of the sheet P is detected by the discharge sensor 13 to confirm whether or not the sheet P has become jammed between the fixation unit 12 and delivery tray 16 (whether or not paper jam has occurred). In this embodiment, the distance (sheet interval) between consecutive two sheets P of the recording medium in the recording medium conveyance passage during a continuous printing operation is 23 mm (0.1 second), and the sheets P are discharged into the delivery tray 16 at a printing speed of 45 sheets per minute.

On the other hand, after the transfer of the toner image onto a sheet P of the recording medium from the photosensitive drum 1, the toner (transfer residual toner, which failed to be transferred onto the sheet P, and therefore, is remaining on the peripheral surface of the photosensitive drum 1) is removed by the cleaning blade 6*a*of the cleaning device 6, to prepare the photosensitive drum 1 for the formation of the next image.

It is possible to form multiple images, one after another, by repeating the image forming operation made up of the above described image formation steps.

2. Fixing Device

Next, the fixation unit 12 is described. In this embodiment, the fixation unit 12 employs a fixation film which is a flexible endless belt, and a pressure roller which is driven to convey a sheet of the recording medium through the fixation unit 12.

To describe more concretely, the fixation unit 12 has a fixation film 12*a*, which is a image fixing rotational component formed of film. The fixation unit 12 has also a pressure roller 12*b*, as a pressure applying component, which is kept in contact with the fixation film 12*a*. Further, the fixation unit 12 has a ceramic heater (which hereafter may be referred to simply as "heater"), as a heat source, which heats the toner on a sheet P of the recording medium, through the fixation film 12*a*. Further, the fixation unit 12 has a heater holder 12*d*, as a supporting component, which supports the heater 12*c*. The fixation film 12*a*, heater 12*c*, heater holder 12*d*, etc., make up the heating section of the fixation unit 12.

In this embodiment, when the fixation film 12*a* is not under the influence of external force, it remains roughly cylindrical, and is 18 mm in diameter. To describe in detail, this fixation film 12*a* has three layers, which is an innermost layer, a primary layer, and a parting layer. The innermost layer is a cylindrical base film which is 30-80 μm in thickness. It is formed of such polyamide resin that dispersively contains thermally conductive filler. The outward surface of the base film is coated with a primer layer which is formed of such fluorinated resin that dispersively contains electrically conductive carbon particles. The primer layer is no more than $1\times10^5\Omega$ in volume resistivity, and 2-20 μm in thickness. The primer layer is covered with a parting layer which is 5-20 μm in thickness. The parting layer is formed of such fluorinated resin that dispersively contains electrically conductive substance.

In this embodiment, the heater 12*c* is made up of an aluminum substrate, a heat generating resistor, and a layer of glass coating. The heat generating resistor, as a heat generating component, is formed of silver alloy, on the surface of the aluminum substrate, by printing. The layer of glass coating covers the surface of the heat generating component. Further, the heater 12*c* is provided with a thermistor (unshown) as a temperature detecting element. It generates heat as AC voltage is applied to the heat generating resistor of the heater 12*c* from an AC power source, which in this embodiment is a commercial power source. The power supply to the heater 12*c*, and the temperature of the heater 12*c*, are controlled by a CPU (unshown), as a control unit, with which the apparatus main assembly M is provided to integrally control various operations carried out by the image forming apparatus 100.

In this embodiment, the external diameter of the pressure roller 12*b* is 20 mm. This pressure roller 12*b* is made up of a metallic core 12*e*, an elastic and heat resistant layer 12*f* formed of silicone rubber or the like, on the peripheral surface of the metallic core 12*e*, and a parting layer (unshown), as the outermost layer, formed on the outward surface of the elastic layer 12*f*, of such a substance, as fluorinated resin, that is excellent in terms of parting properties. The pressure roller 12*b* is under the pressure from compression springs (unshown). Thus, it keeps the fixation film 12*a* pressed on the heater 12*c*, by the outward surface of its parting layer, from the bottom side of the drawing, forming thereby a fixation nip Nf between the fixation film 12*a* and pressure roller 12*b*; the area of contact between the fixation film 12*a* and pressure roller 12*b* is the fixation nip Nf.

As the pressure roller 12*b* is rotationally driven in the direction indicated by an arrow mark R12*b* in the drawing, by a driving power source m1, the fixation film 12*a* is subjected to the rotational force generated by the rotation of the pressure roller 12*b* and the friction between the pressure roller 12*b* and fixation film 12*a* in the fixation nip Nf. Thus, the fixation film 12*a* is rotated by the rotation of the pressure roller 12*b* in the direction indicated by the arrow mark R12*a*, while sliding on the downwardly facing surface of the heater 12*c*, by its inward surface.

Electric power is supplied to the heater 12*c* in such a manner that the temperature of the heater 12*c* increases to a preset level, and remains at the preset level. While the temperature of the heater 12*c* is remaining at the preset level, a sheet P of the recording medium on which an unfixed toner image is present is introduced between the fixation film 12*a* and pressure roller 12*b*, in the fixation nip Nf. Then, the sheet P is conveyed, together with the fixation film 12*a*, through the fixation nip Nf, with the toner image bearing surface of the sheet P remaining in contact with the outward surface of the fixation film 12*a*, while remaining pinched by the pressure roller 12*b* and heater 12*c*. While the sheet P is conveyed, remaining pinched by the fixation film 12*a* and heater 12*c*, through the fixation nip Nf, the heat from the heater 12*c* is given to the sheet P through the fixation film 12*a*. Consequently, the unfixed toner image on the sheet P is welded (fixed) to the sheet P. After being conveyed through the fixation nip Nf, the sheet P is separated from the fixation film 12*a* by the curvature of the fixation film 12*a*.

Here, the above-described layer of glass (glass coating), with which the heat generating resistor of the heater 12*c* is coated, may be thought of as a capacitor, which is roughly several hundreds of pF (200 pF-400 pF) in capacitance. Thus, the AC voltage from the AC power source is transmitted to the fixation nip Nf from the heat generating resistor through the glass coating. Further, in this embodiment, it sometimes occurs that as a sheet P of the recording medium is conveyed through the recording medium conveyance passage, it remains pinched by both the fixation nip Nf and transfer nip Nt at the same time.

In this embodiment, a fixation entrance guide 18, as a guiding component, which guides a sheet P of the recording medium, is disposed on the downstream side of the transfer nip Nt, and also, on the upstream side of the fixation nip Nf, in terms of the conveyance direction of the sheet P. The fixation entrance guide 18 plays the role of guiding the sheet P from the transfer nip Nt to the fixation nip Nf. As the sheet P comes into contact with the fixation entrance guide 18, it is regulated in direction, being thereby correctly guided to the fixation nip Nf, in terms of direction and attitude. The fixation entrance guide 18 is an example of an electrically conductive component with which the sheet P comes into contact while the sheet P is remaining pinched by both the fixation nip Nf and transfer nip Nt. In other words, it is an example of an electrically conductive component other than the photosensitive drum 1, which remains in contact with the sheet P when the sheet P is in contact with the photosensitive drum 1. In this embodiment, the fixation entrance guide 18 is formed of an electrically conductive metallic substance.

The reason why the electrically conductive component is disposed in such a manner that it contacts the sheet P while the sheet P is remaining pinched by both the fixation nip Nf and transfer nip Nt at the same time will be described later.

Further, in this embodiment, a pair of fixation exit rollers 19, which convey a sheet P of the recording medium by holding the sheet P between them, is disposed on the downstream side of the fixation nip Nf in terms of the recording medium conveyance direction. Each fixation exit roller 19 is made up of a metallic core, and an elastic layer formed on the peripheral surface of the metallic core. The elastic layer is formed of electrically conductive rubber. The metallic core is electrically grounded.

Figure 2:
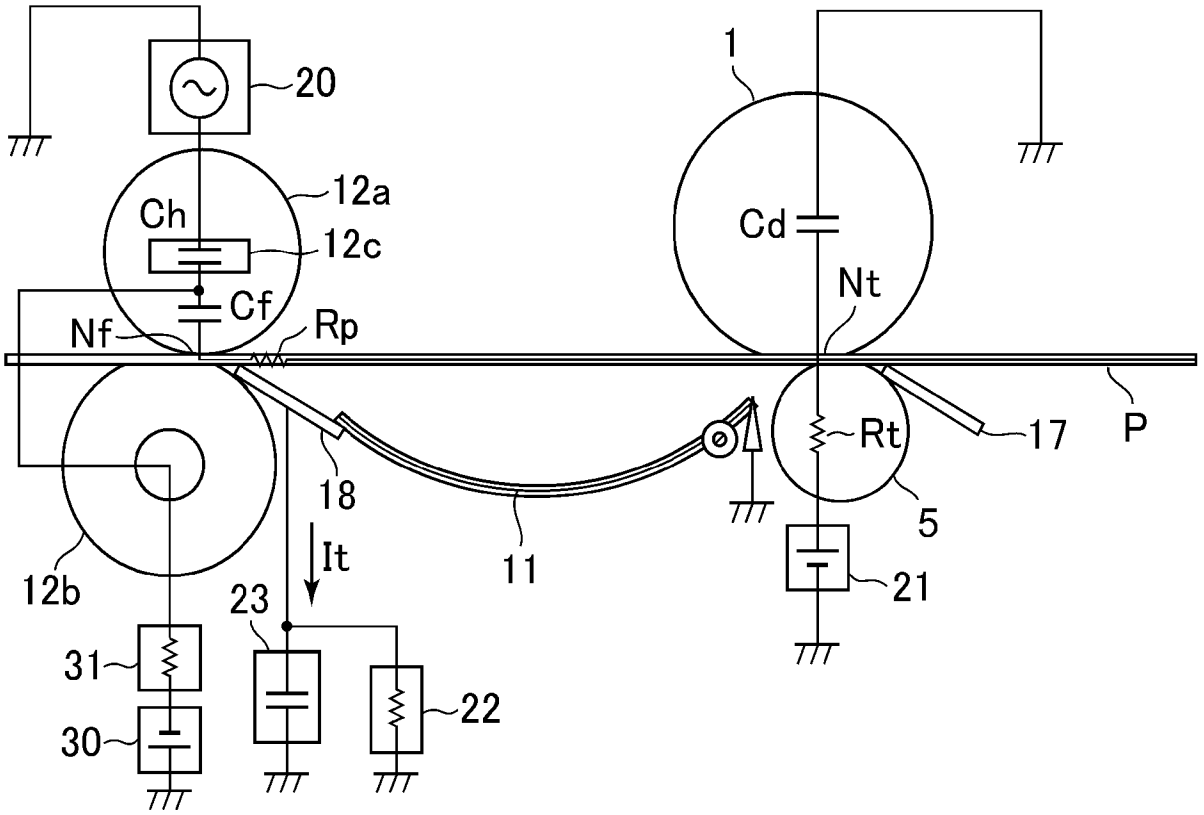
FIG. 2 is a schematic drawing of the essential sections of the image forming apparatus in the first embodiment of the present invention.

In this embodiment, DC voltage (fixation voltage) is applied to the fixation film 12*a* from a fixation electric power source 30 through a current limiting resistor 31 (FIG. 2). As negative DC voltage is applied to the fixation film 12*a* from the fixation power source 30, an electric field which causes the negatively charged toner to move toward the sheet P of the recording medium, is generated in the fixation nip Nf. Therefore, it is possible to prevent the toner particles in the toner image from offsetting to the fixation film 12*a* and/or scattering in the fixation nip Nf.

In this embodiment, the fixation unit 12 is made up of the fixation film 12*a*, pressure roller 12*b*, heater 12*c*, heater holder 12*d*, fixation entrance guide 18, fixation exit rollers 19, etc. This fixation unit 12 is an example of a fixation unit which pinches a sheet P of the recording medium and fixes a toner image to the sheet P by heating the sheet P as AC voltage is applied to the fixation film 12*a*.

3. Description of Difference Between Image Forming Apparatus Unit in this Embodiment and Comparative Image Forming Apparatuses Next, the effects of this embodiment are described in detail in comparison to those of comparative image forming apparatuses. FIG. 2, and FIGS. 5-9, schematically show the essential structural and electrical portions of the image forming apparatus 100 in this embodiment, and those of comparative image forming apparatuses 1-5. The comparative image forming apparatuses 1-5 are practically the same in structure as the image forming apparatus 100 in this embodiment, unless specifically noted.

Referential codes Ch and Cf in the drawings stand for the capacitance of the glass coating which functions as a capacitor, and the capacitance of the fixation film 12*a* which also functions as a capacitor, respectively. The combination of the capacities Ch, Cf, etc., is the overall capacitance of the portion between the AC voltage source 20 which applies AC voltage to the fixation unit 12, and the fixation nip Nf. Here, however, it is assumed that the capacitance Ch of the glass coating, as a capacitor, of the heater 2*a*, represents the overall capacitance of the abovementioned portion. A referential code Cd stands for the capacitance of the photosensitive drum 1 as a capacitor. Further, a referential code Rp stands for the resistance value of the portion of a sheet P of the recording medium, which is between the fixation nip Nf and transfer nip Nt, and a referential code Rt stands for the sum of the resistance value of the transfer roller 105 and the output impedance of the transfer voltage source 21.

(Comparative Image Forming Apparatus 1)

Figure 5:
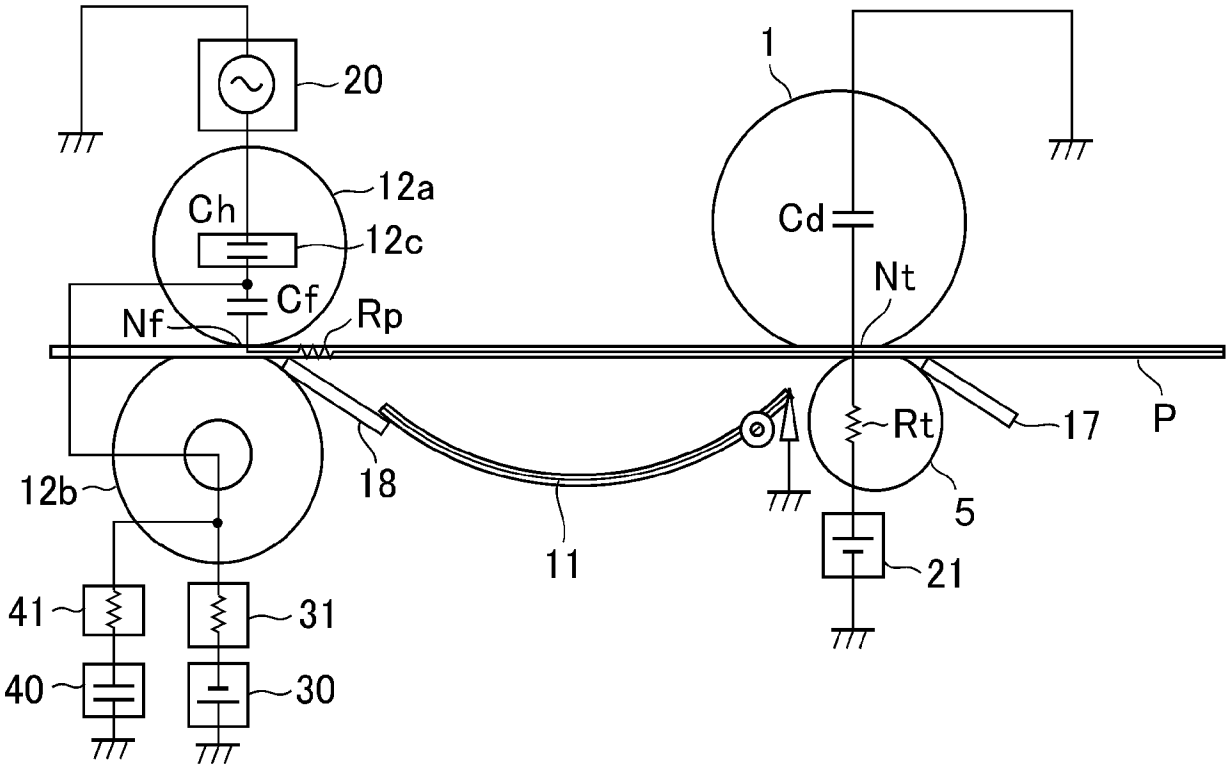
FIG. 5 is a schematic drawing of the essential sections of the first example of comparative image forming apparatus.

In the case of the comparative image forming apparatus 1 shown in FIG. 5, a capacitor 40, and a resistor 41 which is an electrically resistive element, are serially connected to the passage through which the fixation voltage is applied to the fixation film 12*a*. This arrangement is for reducing the AC voltage which applies to the transfer nip Nt from the fixation nip Nf through a sheet P of the recording medium, in order to prevent the occurrence of AC banding images. Further, this arrangement is for reducing the portion of the surface voltage, to which the glass coating, etc., of the heater 12*c* is subjected, in order to prevent the glass coating, etc., from being damaged.

(Comparative Image Forming Apparatus 2)

Figure 6:
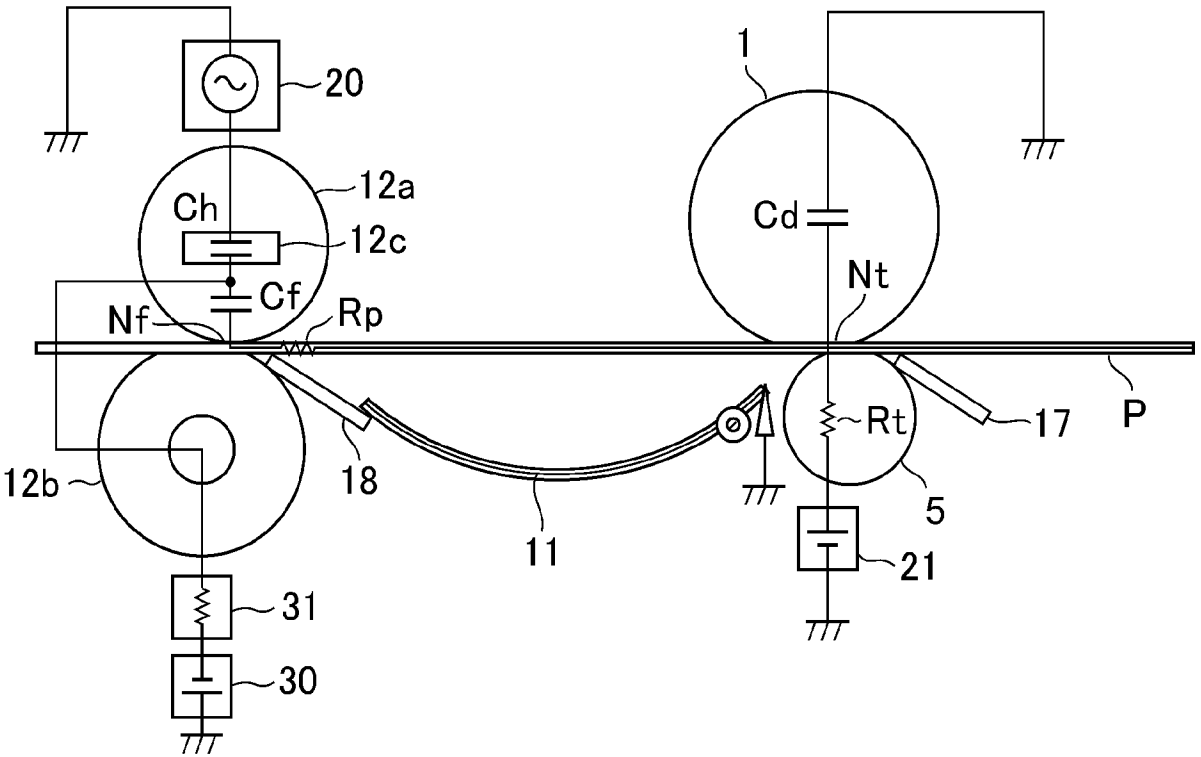
FIG. 6 is a schematic drawing of the essential sections of the second example of comparative image forming apparatus.

Unlike the comparative image forming apparatus 1, the comparative image forming apparatus 2 shown in FIG. 6 is an example of an image forming apparatus which is not provided with such a means, as the capacitor 40 and resistor 41 in the first comparative image forming apparatus, that is for preventing the occurrence of AC banding images by reducing the AC voltage which applies to the transfer nip Nt, in order to prevent the occurrence of AC banding images. That is, the comparative image forming apparatus 2 is what results as the capacitor 40 and resistor 41 are removed from the comparative image forming apparatus 1.

(Comparative Image Forming Apparatus 3)

Figure 7:
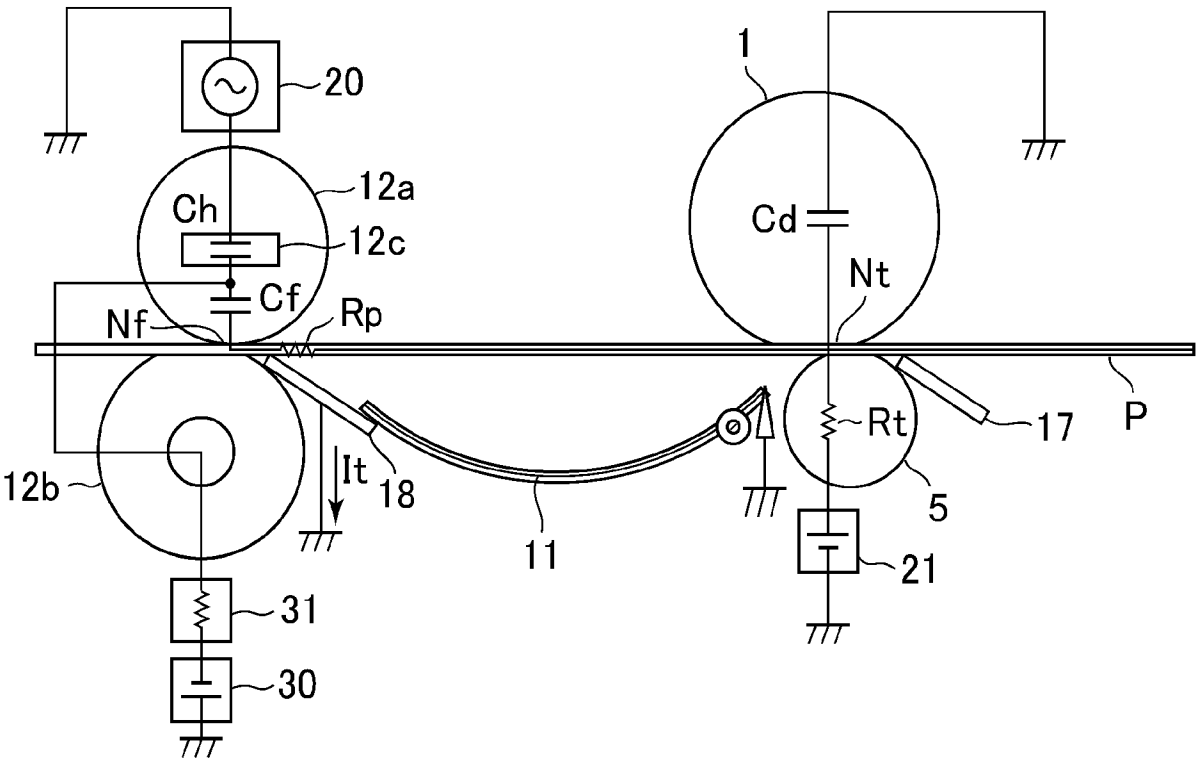
FIG. 7 is a schematic drawing of the essential sections of the third example of comparative image forming apparatus.

In the case of the comparative image forming apparatus 3 shown in FIG. 7, the fixation entrance guide 18 is directly grounded.

A sheet P of the recording medium is conveyed to the transfer nip Nt along the pre-transfer guide 17, and then, is introduced into the transfer nip Nt. As the sheet P is introduced into the transfer nip Nt, it comes into contact with both the photosensitive drum 1 and transfer roller 5, and transfer current is supplied to the transfer nip Nt by the electric field formed by the transfer voltage source 21. A referential code It in the drawings stands for the current (value) which flows from fixation entrance guide 18 to the ground. Referential codes Ita and Itd stands for the AC and DC components, respectively, of this current. The AC voltage from the AC voltage source 20 travels to the transfer nip Nt through the glass coating, fixation film 12*a*, and sheet P, and adds to the transfer voltage in the transfer nip Nt, increasing thereby the transfer voltage in amplitude.

Here, if the fixation entrance guide 18 is directly grounded, the above described AC voltage travels to the ground through the fixation entrance guide 18. Therefore, it is possible to reduce in oscillation (amplitude) the AC voltage in the transfer nip Nt. Therefore, it becomes possible to prevent the occurrence of AC banding images.

In the case of the structure which directly grounds the fixation entrance guide 18, however, the transfer current flows to the ground by way of a sheet P of the recording medium and fixation entrance guide 18, increasing thereby the DC current Itd, when such recording medium as a sheet of paper left unattended in an ambience which is high in temperature and humidity is used for image formation. Therefore, the transfer current sometimes becomes insufficient, which results in the formation of defective images (images having voids attributable to unsatisfactory transfer).

That is, in order to prevent the occurrence of images having voids attributable to unsatisfactory transfer, it is necessary to provide the current passage between the fixation entrance guide 18 and ground, with electrical resistance which is greater than a preset one, to reduce the current Itd which escapes to the ground.

(Comparative Image Forming Apparatus 4)

Figure 8:
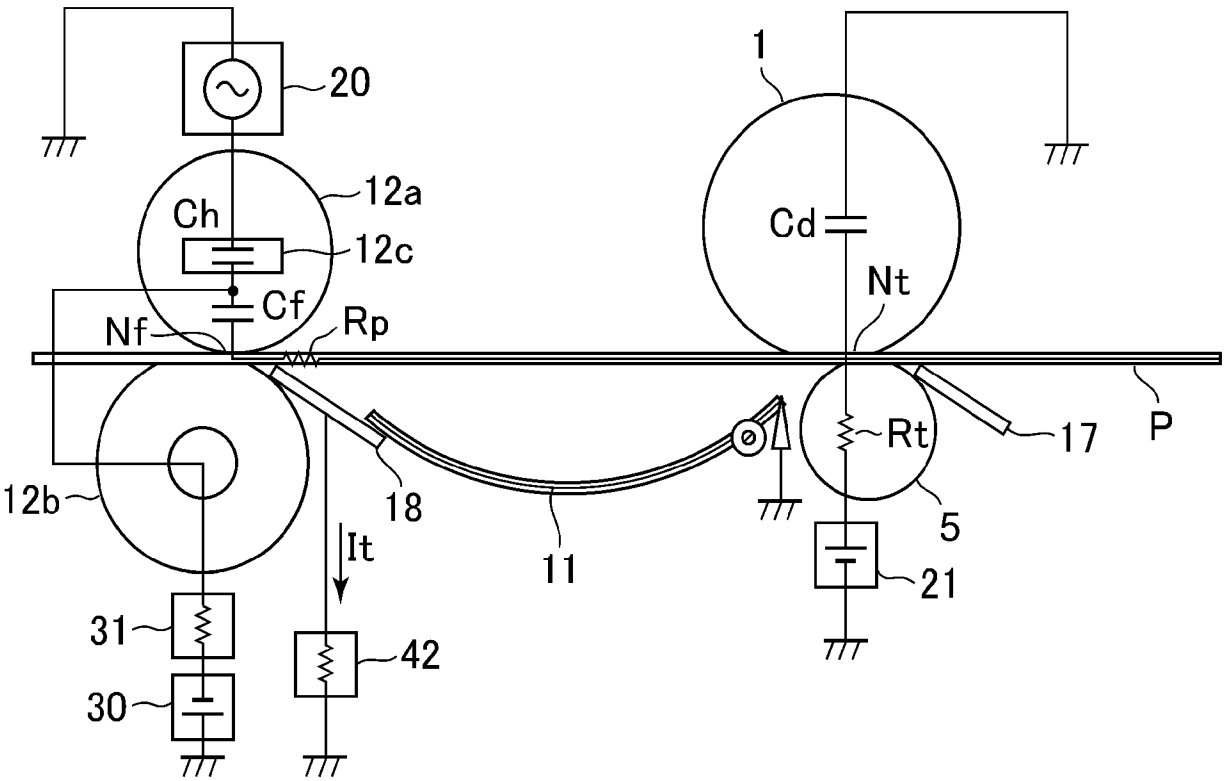
FIG. 8 is a schematic drawing of the essential sections of the fourth example of comparative image forming apparatus.

In the case of the comparative image forming apparatus 4 shown in FIG. 8, a resistor 42, which is an electrically resistant element, is connected between the fixation entrance guide 18 and the ground.

Thus, the current Ltd which escapes to the ground can be reduced by the resistor 42. Therefore, it is possible to prevent the formation of images having transfer voids attributable to unsatisfactory transfer.

However, this setup increases the impedance to the oscillation (amplitude) of the AC voltage generated by the AC voltage source 20. Therefore, its effect is small in terms of the reduction of the AC voltage which travels to the transfer nip Nt from the fixation unit 12 by way of a sheet P of the recording medium. Therefore, it is unsatisfactory as a means for preventing the occurrence of AC banding images.

(Comparative Image Forming Apparatus 5)

Figure 9:
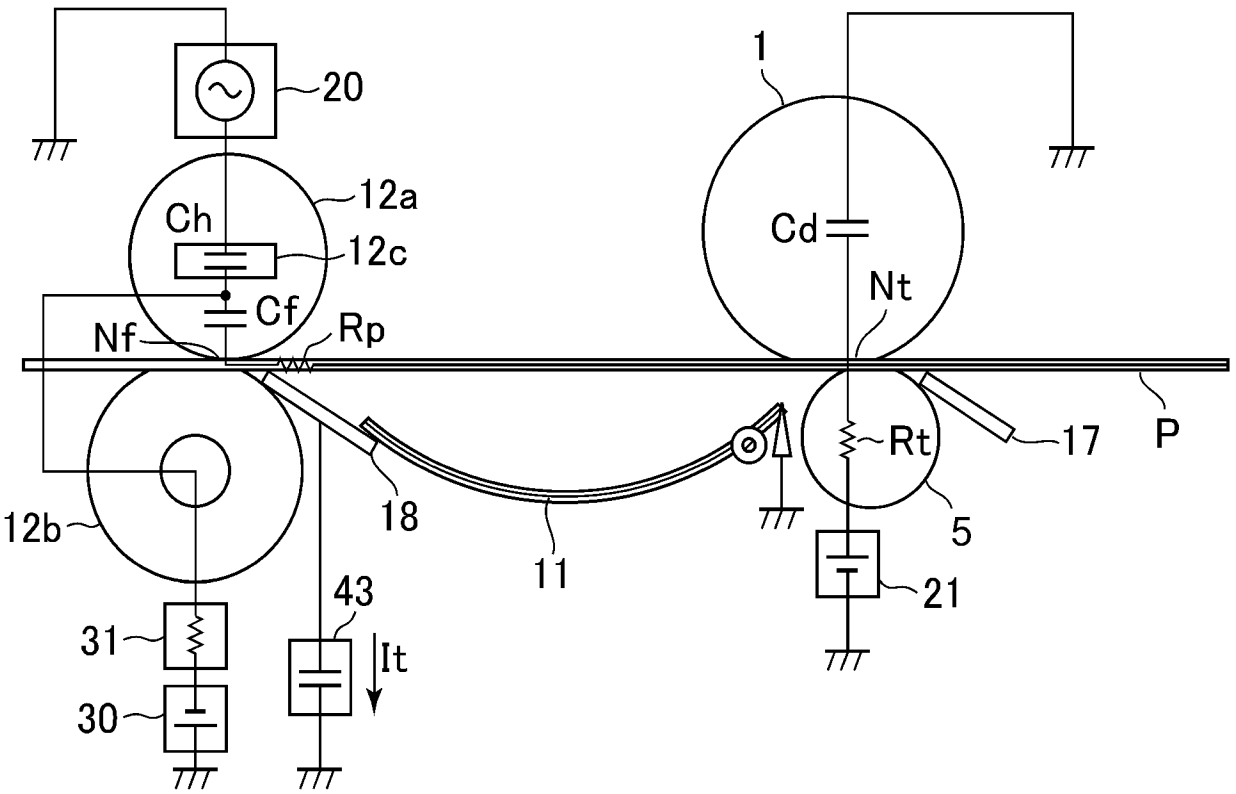
FIG. 9 is a schematic drawing of the essential sections of the fifth example of image forming apparatus.

In the case of the comparative image forming apparatus 5 shown in FIG. 9, in order to achieve both the prevention of the occurrence of AC banding images, and the occurrence of images having voids attributable to unsatisfactory transfer, a capacitor 43 is connected between the fixation entrance guide 18 and ground.

With the connection of the capacitor 43 between the fixation entrance guide 18 and ground, the oscillation of the AC voltage which transmits from the fixation unit 12 to the transfer nip Nt through a sheet P of the recording medium flows to the ground through the capacitor 43, increasing thereby the AC current Ita. Thus, it is possible to reduce in amplitude the AC voltage, in the transfer nip Nt. Therefore, it is possible to prevent the occurrence of AC banding images.

Further, with electrical charge being stored in the capacitor 43, the transfer current, which is DC current, is virtually insulated from the ground. That is, it is possible to reduce the DC current Itd, which flows to the ground, and therefore, it is possible to prevent the occurrence of images having voids attributable to unsatisfactory transfer.

In the case of the comparative image forming apparatus 5, the fixation entrance guide 18 is charged by the friction between the fixation entrance guide 18 and the sheet P when a sheet P of the recording medium, which is high in electrical resistance, or the like recording medium, is used. Thus, it is possible that the fixation entrance guide 18 and toner will repel each other. Therefore, it is possible that toner may be scattered; images having minutes unwanted toner spots may be outputted.

(Evaluation of Images Formed by Comparative Image Forming Apparatuses)

The comparative image forming apparatuses 1-5 were evaluated in terms of the relationship between the fluctuation of the transfer current in the transfer nip Nt, and image defects, in an ambience which is high in temperature and humidity (30° C. and 80%). The recording medium used for the image evaluation was recording paper OceRedLabel (product of Canon Co., Ltd.), which was A4 in size and 80 g/m$^2$ in basis weight. It was used after being left unattended in the above described ambience for a substantial length of time. The images obtained with the use of these comparative image forming apparatuses were evaluated regarding AC banding (nonuniformity in density, which is attributable to fluctuation (excessive or insufficient) in the amplitude of the transfer voltage, which occurs in synchronism with the cycle of AC voltage), image having transfer voids (resulted because parts of toner image failed to be transferred due to insufficiency in transfer current), and images having minutes toner spots attributable to scatter toner. As for evaluation standard (reference), various images designed for the evaluation of the above-described concerns were outputted with the use of the comparative image forming apparatuses. Then, the images which are free of the above described defects, and the images which suffers from the above described defects, but, are acceptable in practical terms, are evaluated as OK. The images, the defects of which are unacceptable in practical terms, were evaluated as no good (NG). By the way, during the formation of these images used for evaluation, roughly 1 kV of transfer voltage was outputted from the transfer current power source 21, and the amount of the transfer current which flowed to the photosensitive drum 1 was roughly 10 μA.

Unlike the comparative image forming apparatus 2 which was not provided with a means for preventing the occurrence of AC banding images, the comparative image forming apparatus 1 was able to reduce the AC transfer voltage in amplitude (peak-to-peak voltage) from 350 V to 200 V, in the transfer nip Nt. In other words, the comparative image forming apparatus 1 has a certain amount of effect upon the prevention of the occurrence of AC banding images. However, increasing the capacitor in capacitance for effectiveness increases the surge voltage, attributable to lightening or the like, which applies to the glass coating of the heater 12. Thus, it may result in the damage to the heater 12*c* or the like. Thus, the capacitance of the capacitor 40 should not be made greater than a preset amount. Further, even if the capacitor 40, the capacitance of which is 4,700 pF, or the largest capacitance in a range in which the above described damage does not occur, is used, the amplitude (peak-to-peak voltage) of the transfer voltage becomes 200 V in the transfer nip Nt, and therefore, AC banding images sometimes occurred. In the case of the comparative image forming apparatus 1, therefore, it is difficult for the comparative image forming apparatus 1 to prevent the occurrence of AC banding images, while preventing the heater 12*c* and the like from being damaged by surge voltage.

In the case of the comparative image forming apparatus 3, the AC voltage is allowed to escape to the ground in the transfer nip Nt. Therefore, the amplitude (peak-to-peak voltage) of the transfer voltage in the transfer nip Nt reduced to 40 V, and therefore, there was no occurrence of AC banding images. However, the DC component of the transfer current escaped to the ground through a sheet P of the recording medium and fixation entrance guide 18. Thus, images having transfer voids sometimes occurred.

In the case of the comparative image forming apparatus 3, the AC voltage is allowed to escape to the ground in the transfer nip Nt. Therefore, the amplitude (peak-to-peak voltage) of the transfer voltage in the transfer nip Nt reduced to 40 V, and therefore, there was no occurrence of AC banding images. However, the DC component of the transfer current escaped to the ground through a sheet P of recording medium and fixation entrance guide 18. Thus, images having transfer voids sometimes occurred.

In the case of the comparative image forming apparatus 4, it was possible to prevent the transfer current from escaping to the ground. However, the AC voltage which escapes to the ground reduces in amplitude. Thus, the amplitude (peak-to-peak) of the transfer voltage in the transfer nip Nt became 250 V, which sometimes resulted in the occurrence of AC banding images.

In the case of the comparative image forming apparatus 5, it is equipped with the capacitor 43 which is relatively large in capacitance. Therefore, it is possible to allow the amplitude of the AC voltage to escape without going through a resistor. Therefore, when the capacitor 40, which is 47,000 pF in capacitance, was used, it was possible to reduce the amplitude (peak-to-peak) voltage of the transfer voltage in the transfer nip Nt to a value as low as 100 V. Therefore, there was no occurrence of AC banding images. However, in the case of the comparative image forming apparatus 5, the fixation entrance guide 18 is charged by the friction between the fixation entrance guide 18 and a sheet P of the recording medium, when the sheet P, which is high in electrical resistance, is used as the recording medium. Thus, the toner and fixation entrance guide 18 repel each other, which sometimes resulted in the occurrence of images having unwanted minute toner spots. As for the recording medium with high electrical resistance, sheets of OceRedLabel (product of Canon Co., Ltd.) which is A4 in size and 80 g/m$^2$ in basis weight were used after being left unattended in an environment which was low in temperature and humidity (10° C. and 15%, respectively).

As descried above, making the current Ltd excessively small causes an image forming apparatus to output images having unwanted minute toner spots. Thus, from the standpoint of preventing the occurrence of images having transfer voids and images having unwanted minute toner spots, the current Itd is desired to be kept in a preset range. That is, in a case where the electrically conductive component 18 is in the portion of the recording medium conveyance passage, which is between the transfer nip Nt and fixation nip Nf, simply connecting the capacitor 43 between the electrically conductive component 18 and ground sometimes causes the electrically conductive component 18 to be charged by the friction between the electrically conductive component 18 and sheet P of the recording medium. This charging of the electrically conductive component 18 sometimes results in the occurrence of images having unwanted minute toner spots attributable to the toner scattered by the charging of the electrically conductive component 18.

(Evaluation of Image Forming Apparatus in this Embodiment)

Referring to FIG. 2, in this embodiment, the capacitor 23, and resistor 22 which is an electrically resistive element, are connected in parallel between the fixation entrance guide 18 and ground. That is, the fixation entrance guide 18 is in connection to one end of the capacitor 23 and one end of the resistor 22, whereas the other end of the capacitor 23 and the other end of the resistor 22 are in connection to the ground. The capacitor 23 is for increasing the current Ita to prevent the occurrence of AC banding images. The resistor 22 is for keeping the current Ita to prevent the occurrence of images having unintended voids attributable to transfer errors, and also, to prevent the charging of the fixation entrance guide 18. Thus, it is possible to prevent the charging of fixation entrance guide 18; it is possible to prevent the fixation entrance guide 18 from being charged, and also, to reduce in potential the charge attributable to the friction between the fixation film 12*a* and a sheet of the recording medium.

In this embodiment, in order to keep stable the surface potential level of the fixation film 12*a*, the metallic core 12 of the pressure roller 12*b* is grounded in some cases. In such cases, as a sheet P of the recording medium enters the fixation nip Nf, the transfer current escapes to the fixation nip Nf. Thus, the transfer performance in the transfer nip Nt prior to the introduction of the sheet P into the fixation nip Nf is different from that after the introduction of the sheet P into the fixation nip Nf making it sometime impossible to keep the transfer nip Nt uniform in transfer performance. Therefore, from the standpoint of preventing the occurrence of images having transfer voids, while keeping the transfer nip Nt stable in transfer performance from when the sheet P enters the transfer nip Nt to when the sheet P comes out of the transfer nip Nt, it is not desired to excessively increasing the resistor 22 in resistance. That is, from the standpoint of preventing the occurrence of an image having unwanted voids attributable to the escape of the transfer current, it is desired that the resistance (value) of the resistor 22 is made to be greater than a preset value. However, from the standpoint of obtaining an image which is uniform in appearance, the resistor 22 is desired to be no more in resistance value than a preset value so that the difference between the amount by which transfer current escapes prior to the entrance of the sheet P into the fixation nip Nf, and that after the entrance the sheet P into the fixation nip Nf, becomes as small as possible. As described above, optimal value for the resistance for the resistor 22 which is connected between the fixation entrance guide 18 and ground, varies according to the concrete structure of the image forming apparatus 100 to which the present invention is applied.Thus, the resistor 22, which is connected between the fixation entrance guide 18 and ground of the image forming apparatus 100 in this embodiment was varied in resistance to 20 MΩ, 30 MΩ, 40 MΩ, and 50 MΩ, and the conditions under which images having transfer voids and/or an image having unwanted minute toner spots attributable to the scattered toner, occurred or did not occur were studied. The results are: when the resistor 22 was no more than 30 MΩ in resistance, it was possible to prevent the occurrence of an image having minutes unwanted toner spots attributable to the scattered toner. However, its effect was insufficient in terms of the prevention of the occurrence of an image having transfer voids. In comparison, when the resistor 22 was 50 MΩ in electrical resistance, the portion of an image, which was transferred prior to the entrance of a sheet P of the recording medium into the fixation nip Nf, was different in density from the portion of the image, where was transferred after the entrance of the sheet P into the fixation nip Nf. This proved that the optimal amount of electrical resistance for the resistor 22 of the image forming apparatus 100 in this embodiment is 40 MΩ.

Further, regarding the capacitance of the capacitor 23 to be connected between the fixation entrance guide 18 and ground, the greater it is, the more effective to prevent the occurrence of an AC banding image. This capacitor 23 is indirectly connected to only the heater 12*c* through a sheet P of the recording medium. Therefore, from the standpoint of preventing the surge voltage attributable to lightening or the like from being applied by an excessive amount to the glass coating, etc., of the heater 12*c*, it is unnecessary for the resistor to be serially connected to this capacitor 23. Further, even if the resistor which is to be serially connected to the capacitance 23 is not provided, the capacitor 23 can be made as high in capacitance as possible. The capacitance of the capacitor 23 of the image forming apparatus 100 in this embodiment was set to 4,700 pF, 10,000 pF, 30,000 pF, and 47,000 pF, and whether or not AC banding images were outputted, and also, under which condition the AC banding images occur were studied. As a result, it was confirmed that the higher in capacitance the capacitor 23, the more effective it is to prevent the occurrence of an AC banding image. In consideration of the above described results, in this embodiment, a resistor 22 which is 40 MΩ in resistance, and a capacitor 23 which is 47,000 pF, were connected in parallel between the fixation entrance guide 18 and ground.

In the high temperature-high humidity environment, the oscillation (peak-to-peak value) of the transfer current in the transfer nip Nt became 80 V, and there was no occurrence of an AC banding image. Further, because the resistor 22 was connected between the fixation entrance guide 18 and ground, it was possible to keep the current Itd small, and therefore, there was no occurrence of an image having unwanted voids attributable to unsatisfactory image transfer.

(Evaluation of Images Outputted by Image Forming Apparatus in this Embodiment)

Images outputted by the image forming apparatus 100 in this embodiment in an environment which was high in temperature and humidity (30° C./80%) and an environment which was low in temperature and humidity (10° C./15%), were evaluated to find the relationship between the oscillation of the transfer current in the transfer nip Nt, and image defects. The recording medium used for forming the images for evaluation were sheets of paper OceRedLabel (product of Canon Co., Ltd.) which are 80 g/m$^2$ in basis weight and A4 in size, and which had been left unattended for a substantial length of time. The evaluation method, evaluation items, evaluation standard, etc., are the same as those used for evaluation of the images outputted by comparative image forming apparatuses 1-5. The results of the evaluation are given later in Table 1.

In comparison, in the low temperature-low humidity environment, the fixation entrance guide 18 was not completely insulated from the ground, because the resistor 22 was connected between the fixation entrance guide 18 and ground, although there was friction between the fixation entrance guide 18 and a sheet P of the recording medium. Therefore, it did not occur that the fixation entrance guide 18 is continuously charged. Therefore, there was no occurrence of an image having unwanted minute toner spots attributable to the scattering of toner.

As described above, according to this embodiment, not only is it possible for the AC current Ita to be allowed to sufficiently escape to the gourd through the fixation entrance guide 18, but also, for the amount by which the DC current Itd to escape to the ground through the fixation entrance guide 18 to be kept in a preset range. Therefore, not only it is possible to prevent by the capacitor 23, the occurrence of an AC banding image, but also, to prevent by the capacitor 23, the occurrence of an image having unwanted voids attributable to unsatisfactory transfer, and an image having minute unwanted toner spots attributable to the scattering of toner. As described above, according to this embodiment, it is possible to prevent the occurrence of AC banding images attributable to the transmission of AC voltage to the transfer nip Nt through a sheet P of the recording medium, images having unwanted voids attributable to unsatisfactory toner image transfer resulting from the insufficiency in transfer current, and image defects attributable to the overcharging of the fixation entrance guide 18 as an electrically conductive component.

[Embodiment 2]

Next, another embodiment of the present invention is described. The basic structure and operation of the image forming apparatus 100 in this embodiment are practically the same as those of the image forming apparatus in the first embodiment. Therefore, the components of the image forming apparatus in this embodiment, which are the same as, or similar to, the counterparts in the first embodiment, in structure and function, are given the same referential codes as those given to the counterparts, and are not described in detail.

In the first embodiment, the fixation entrance guide 18 was used as an electrically conductive component, with which a sheet P of the recording medium comes into contact while the sheet P remains pinched by both the fixation nip Nf and transfer nip Nt at the same time, and which is disposed on the upstream side of the fixation nip Nf, and on the downstream side of the transfer nip Nt, in terms of the direction in which the sheet P is conveyed. In comparison, in this embodiment, a pre-transfer guide 17 is disposed, as a guiding component for guiding the sheet P, on the upstream side of the transfer nip Nt in terms of the recording medium conveyance direction, like the fixation entrance guide 18 in the first embodiment. The pre-transfer guide 17 controls the direction in which the sheet P is conveyed to guide the sheet P to the transfer nip Nt, as the sheet P comes into contact with the pre-transfer guide 17. In this embodiment, the pre-transfer guide 17 is formed of an electrically conductive metallic substance. Thus, the pre-transfer guide 17 is used as an electrically conductive component which contacts the sheet P while the sheet P remains pinched by both the fixation nip Nf and transfer nip Nt at the same time. It is disposed on the upstream side of the transfer nip Nt, in terms of the recording medium conveyance direction. The pre-transfer guide 17 in the second embodiment has two sections, that is, a top guide 17*a* and a bottom guide 17*b*. Therefore, it is ensured that the sheet P comes into contact with the pre-transfer guide 17 by at least one of the two surfaces, that is, top and bottom surfaces.

It is possible to connect a capacitor between the pre-transfer guide 17 and ground as in the case of the comparative image forming apparatus described with reference to FIG. 9. With this connection, the amplitude of the AC voltage which travels from the fixation unit 12 to the transfer nip Nt through a sheet P of the recording medium flows to the ground through the capacitor. Thus, it is possible to reduce the AC voltage in the transfer nip Nt, and also, to prevent the transfer current (DC current) from escape to the ground.

In this case, however, it sometimes occurred, when a sheet of the recording medium, which is high in resistance, was used as the recording medium, that the pre-transfer guide 17 was charged by the friction between the pre-transfer guide 17 and sheet P, causing thereby toner to collect on the pre-transfer guide 17 and soil the sheet P. That is, in a case where the electrically conductive component 17 is on the upstream side of the transfer nip Nt in terms of the recording medium conveyance direction, the electrically conductive component 17 is charged by the friction between the electrically conductive component 17 and sheet P, causing thereby toner to collect on the electrically conductive component 17. Therefore, it sometimes occurred that the sheet P was soiled by the toner.

Figure 3:
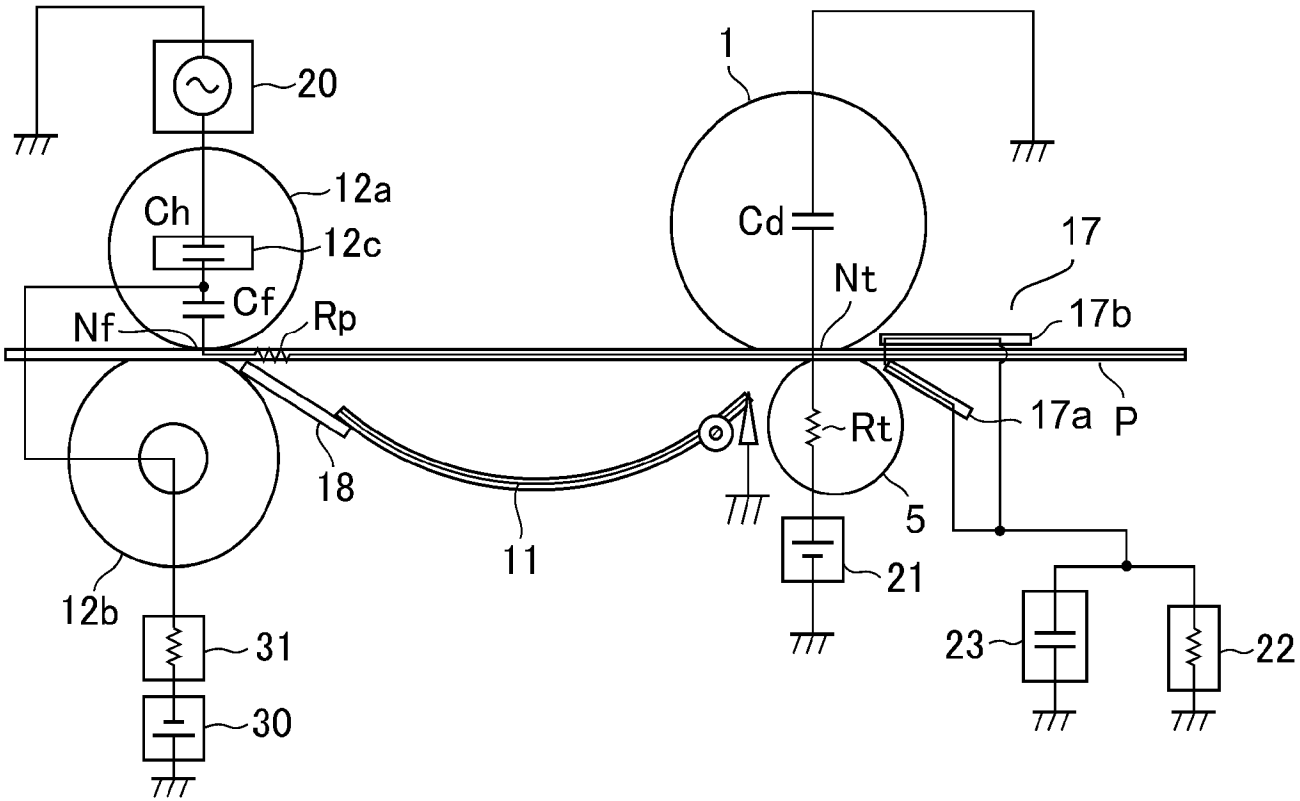
FIG. 3 is a schematic drawing of the essential sections of the image forming apparatus in the second embodiment of the present invention.

Referring to FIG. 3, in this embodiment, therefore, a capacitor 23 which is a storage element, and a resistor 22 which is an electrically resistive element, are connected in parallel between the pre-transfer guide 17 and ground. That is, the pre-transfer guide 17 is in connection to one end of the capacitor 23, and also, one end of the resistor 22, and the other end of the capacitor 23 and the other end of the resistor 22 are grounded. In this embodiment, the resistor 22 which is 40 MΩ in resistance, and the capacitor 23 which is 47,000 pF in capacitance, were connected in parallel between the pre-transfer guide 17 and ground.

The images outputted by the image forming apparatus in this embodiment were evaluated in the similar manner to the manner in which those outputted by the image forming apparatus in the first embodiment, and comparative image forming apparatuses 1-5, were evaluated. The results of the evaluation are given in Table 1.

From the standpoint of ensuring that various sheets of the recording medium which are different in stiffness are reliably conveyed regardless of their difference in stiffness, it is desired that the direction in which each sheet P of the recording medium is conveyed is controlled by a component (components) on (in) the recording medium passage. In particular, from the standpoint of ensuring that each sheet P of the recording medium is reliably delivered to the transfer nip Nt, it is desired that the pre-transfer guides 17 are disposed on both the top and bottom sides of the recording medium passage (on both top and bottom sides of sheet P) to control the direction in which each sheet P is conveyed. In this embodiment, the pre-transfer guide 17 is on the upstream side of the transfer nip Nt in terms of the recording medium conveyance direction. Therefore, while the sheet P is conveyed to the pre-transfer guide 17, there is no unfixed toner image on the sheet P. Therefore, it is easy to control the recording medium conveyance by placing the pre-transfer guide 17 on both the top and bottom sides of the sheet P in terms of the vertical direction. In comparison, the fixation entrance guide 18 is on the downstream side of the transfer nip Nt in terms of the recording medium conveyance direction. Therefore, there is an unfixed toner image on the sheet P when the sheet P is conveyed to the fixation entrance guide 18. Therefore, it is rather difficult to control the direction in which the sheet P is conveyed, by the surface of the sheet P, on which the unfixed toner image is present. From the standpoint of ensuring that each sheet P of the recording medium is reliably conveyed to the fixation nip Nf, therefore, it is likely for the fixation entrance guide 18 to be placed on the bottom side (backside of sheet P) in terms of the vertical direction. Thus, it is possible that a sheet P of the recording medium will not come into contact with the fixation entrance guide 18, although it depends on the recording medium type, and also, the state in which the sheet P is being conveyed.

Therefore, it is desired that the pre-transfer guide 17 is placed on both the top and bottom sides of the recording medium passage (top and bottom sides of sheet P), in terms of the vertical direction, to control the direction in which the sheet P is conveyed, and also, that the capacitor 23 and resistor 22 are connected in parallel between the pre-transfer guide 17 and ground. With this setup, it becomes easier to obtain such effects as preventing the occurrence of AC banding images, and images having transfer voids, etc., across the entirety of the sheet P. In this embodiment, the pre-transfer guides 17 were placed on both the top and bottom sides of the recording medium conveyance passage (top and bottom surfaces of sheet P) in terms of the vertical direction.

In comparison, the structure in the first embodiment places an electrically conductive component, which is the fixation entrance guide 18, closer to the source of the AC voltage than the structure in the second embodiment, being therefore less in the amount by which the AC voltage is reduced in amplitude. Therefore, the structure in the first embodiment can be smaller in the capacitance which the capacitor 23 needs to obtain the above described effects than the structure in this embodiment. In other words, this embodiment is smaller in cost than the first embodiment.

As described above, the structure in this embodiment requires the capacitor to be greater in capacitance than the structure in the first embodiment. However, the structure in this embodiment makes it easier to ensure that a sheet P of the recording medium comes into contact with the electrically conductive component, making it easier to obtain such effects as the prevention of the occurrence of AC banding images, images having transfer voids, etc., across roughly the entire of the sheet P, than the structure in the first embodiment.

[Embodiment 3]

Next, another embodiment of the present invention is described. The basic structure and operation of the image forming apparatus in this embodiment are practically the same as those of the image forming apparatus in the first embodiment. Therefore, the components of the image forming apparatus in this embodiment, which are the same as, or similar to, the counterparts in the first embodiment, in structure and function, are given the same referential codes as those given to the counterparts, and are not described in detail.

In this embodiment, a fixation exit roller 19 is employed as an electrically conductive component which contacts a sheet P of the recording medium when the sheet P is being pinched by both the fixation nip Nf and transfer nip Nt at the same time. In terms of the direction in which the sheet P is conveyed, the fixation exit roller 19 is placed on the downstream side of the fixation nip Nf.

Figure 4:
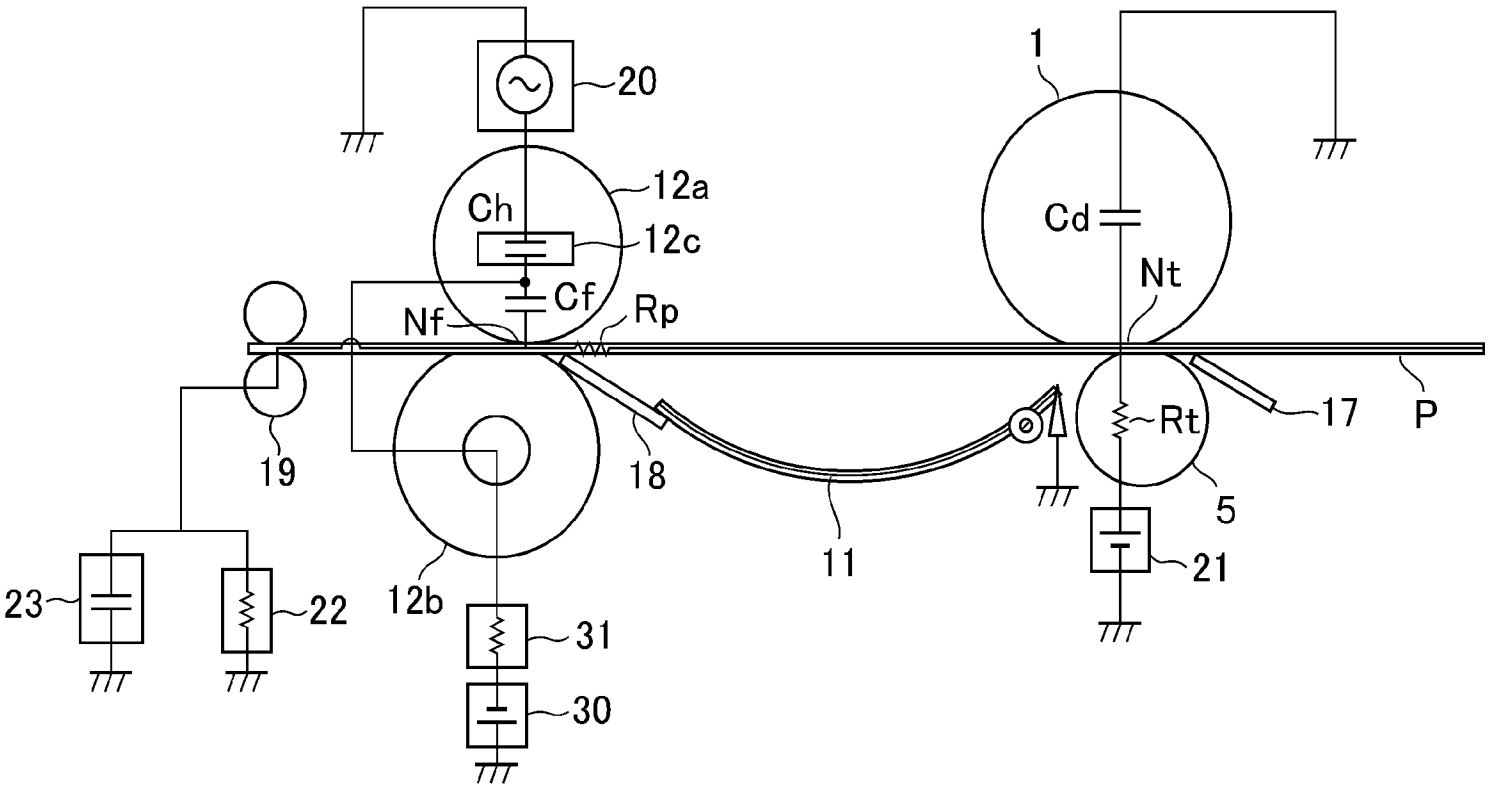
FIG. 4 is a schematic drawing of the essential sections of the image forming apparatus in the third embodiment of the present invention.

That is, referring to FIG. 4, in this embodiment, the capacitor 23 which is a storage element, and the resistor 22 which is an electrically resistive element, are connected in parallel between the fixation exit roller 19 which is an electrically conductive roller, with which a sheet P of the recording medium comes into contact after it passes through the fixation nip Nf, and the ground. That is, the fixation exit roller 19 is in connection to one end of the capacitor 23 and one end of the resistor 22, whereas the other end of the capacitor 23 and the other end of the resistor are grounded. In this embodiment, the resistor 22 which is 40 MΩ in resistance and the capacitor 23 which is 47,000 pF in capacitance, were connected in parallel between the fixation exit roller 19 (more precisely, at least one of pair of fixation exit rollers 19) and the ground.

The images outputted by the image forming apparatus in this embodiment were evaluated in the similar manner to the manner in which those outputted by the image forming apparatus in the first embodiment, and comparative image forming apparatuses 1-5, were evaluated. The results of the evaluation are shown in Table 1, which will be provided later.

Generally speaking, as a sheet P of the recording medium is conveyed through the fixation nip Nf, the moisture in the sheet P evaporates. Thus, the volume resistivity of the sheet P is higher on the downstream side of the fixation nip Nf than on the upstream side of the fixation nip Nf in terms of the recording medium conveyance direction. In the case of the structure in this embodiment, it is difficult for the amplitude of the AC voltage to transmit. Thus, if it is necessary to obtain the same effects as those in the first embodiment, the capacitor 23 which is to be connected between the fixation exit roller 19 and ground has to be increased in capacitance. On the other hand, the fixation exit roller 19 contacts the sheet P after the fixation of the toner image on the sheet P. Therefore, the fixation unit in this embodiment is as easy as the fixation unit 12 in the second embodiment to structure to ensure that the sheet P comes into contact with the fixation exit roller 19. Therefore, it is more effective in terms of the prevention of the occurrence of AC banding images and images having transfer voids, across the entire area of the sheet P.

As described above, even in a case where the resistor 22 and capacitor 23 are connected in parallel to the electrically conductive component 19 which is placed on the downstream side of the fixation nip Nf in terms of the recording medium conveyance direction, it is possible to prevent the occurrence of AC banding images and images having transfer voids.

TABLE 1

| | Oscillation of transfer | Images OK/NG | | |
|---|---|---|---|---|
| | Voltage PtoP (V) | AC banding | Transfer void | Scattering image |
| Comp. Ex. 1 | 200 | NG | OK | OK |
| Comp. Ex. 2 | 350 | NG | OK | OK |
| Comp. Ex. 3 | 40 | OK | NG | OK |
| Comp. Ex. 4 | 250 | NG | OK | OK |
| Comp. Ex. 5 | 100 | OK | OK | NG |
| Emb. 1 | 80 | OK | OK | OK |
| Emb. 2 | 90 | OK | OK | OK |
| Emb. 3 | 100 | OK | OK | OK |

[Embodiment 4]

Next, another embodiment of the present invention is described. The basic structure and operation of the image forming apparatus in this embodiment are practically the same as those of the image forming apparatus in the first embodiment. Therefore, the components of the image forming apparatus in this embodiment, which are the same as, or similar to, the counterparts in the first embodiment, in structure and function, are given the same referential codes as those given to the counterparts, and are not described in detail.

The structure in the fourth embodiment is capable of dealing with an image forming operation which is higher in printing speed and small in sheet intervals. In a case where sheet intervals are greater than a preset value, the electrical charge accumulated in the capacitor 23 is discharged while the recording medium is in contact with an electrically conductive component such as the fixation entrance guide 18 during sheet intervals. It is possible, however, that the electrical charge accumulated in the capacitor 23 will not be fully discharged, as sheet intervals are reduced as in the case of the fixation nip Nf in this embodiment. If it is not ensured that there is a sufficient amount of margin between the transfer bias which is actually outputted, and the minimum amount of transfer bias necessary for the image transfer onto a sheet P of the recording medium, the transfer current will escape until electrical charge accumulates in the capacitor 23 connected between an electrically conductive component, such as the fixation entrance guide 18, and the ground, and therefore, it sometimes occurs that the electric current necessary for transfer becomes insufficient. As electric charge accumulates in the capacitor by an amount which is greater than a preset value, the amount by which the transfer current escapes to the capacitor reduces. Therefore, there is a problem that the transfer performance of the fixation unit 12 prior to the accumulation of a certain amount of electric charge accumulates in the capacitor is different from that after the accumulation of the certain amount of electric charge in the capacitor. In such a case, it is rather difficult to keep the image forming apparatus 100 stable in image quality throughout an image forming operation, that is, from the beginning to the end of the printing operation. Thus, in order to ensure that the image forming apparatus remains stable in image quality throughout a given image forming operation, it has to ensured that even when sheet intervals are shortest, the electric charge having accumulated in the capacitor 23, is allowed to sufficiently discharge before the leading edge of each sheet P of the recording medium enters the transfer nip.

The greater in capacitance the capacitor, the greater the amount by which the transfer current escapes to the capacitor through the sheet P, and therefore, the longer the time necessary for the discharging of the capacitor. In a case where sheet intervals are long; the capacitor is small in capacitance; and/or the resistor is low in resistance value, and therefore, the capacitor can be sufficiently discharged, the possibility that the transfer unit will be changed in transfer performance by the electrical resistance of the recording paper during an image forming operation is sufficiently small.

During sheet intervals, an electrically conductive component, such as the fixation entrance guide 18, is not in contact with a sheet P of paper. Therefore, it is reasonable to think that discharging of the capacitor is determined mainly by the constants of the capacitor and resistor connected between the above described electrically conductive component and the ground, and also, that the discharging of the capacitor 23 during sheet intervals is related to a RC circuit which is little to do with the electrical resistance of sheet of paper, etc.

[Evaluation of Images Outputted by Image Forming Apparatus in Embodiment 4]

The image forming apparatus 100 in this embodiment was operated under a condition that is 230 mm/sec in process speed, 12 mm (0.05 second) in sheet intervals, which is shorter than that for the image forming apparatuses in the preceding embodiment, and 47 images per minute in printing speed.

Figure 10:
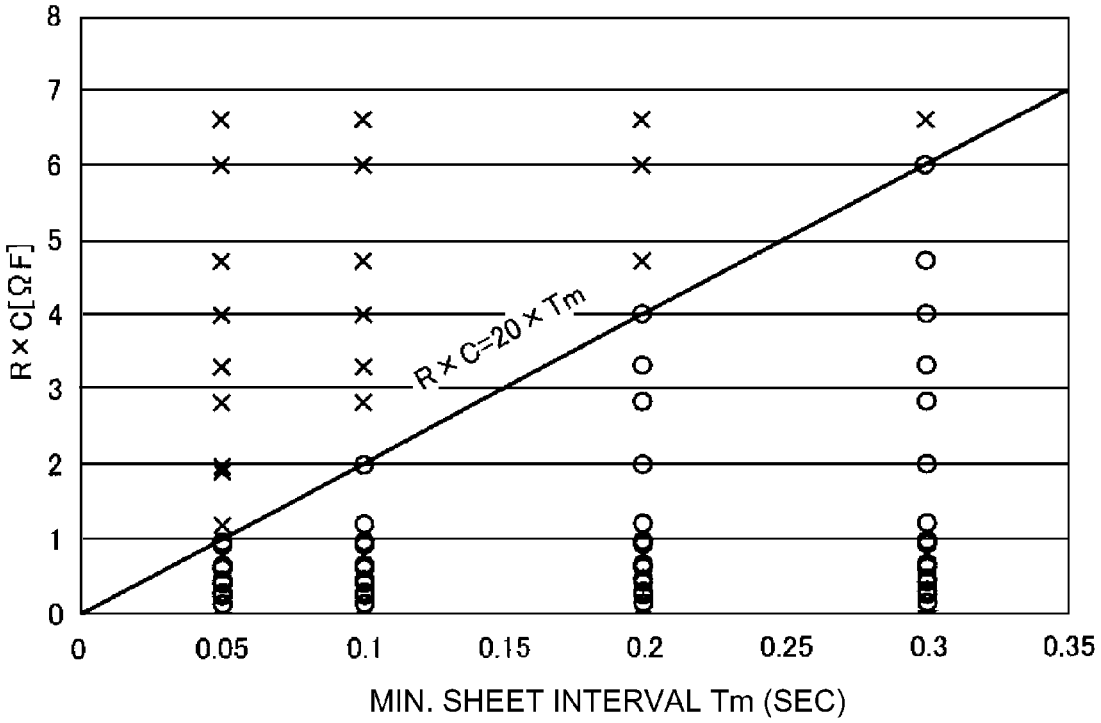
FIG. 10 is a graph which shows the results of the evaluation of the images formed by the image forming apparatus in the fourth embodiment of the present invention.

The relationship between the sheet intervals (in terms of length of time) and image defects were examined under a high temperature-high humidity (30° C/80%) condition. For the image evaluation, images were formed using sheets of paper (OceRedLabel (product of Canon Co., Ltd.) which is A4 in size and 80 g/m$^2$ in basis weight, and which had been left unattended for a substantial length of time. Based on the results of the evaluation of the images formed by the image forming apparatuses in the embodiments 1-3, a capacitor which is greater in capacitance than 4,700 pF was used. The targets of evaluation were images having transfer voids, and AC banding images. As for the standard of evaluation, 30 various images for evaluation were continuously outputted. Then, when 30 images were not different in terms of the level of image defect, the relationship was considered satisfactory (OK or G). When even one of 30 images is different from the rest, it was considered no good (NG). The results of the evaluation are given in Table 2 which is provided later. FIG. 10 graphically shows the results.

It is evident from the results of the evaluation given in Table 2 and FIG. 10 that the electrical discharge during sheet intervals is determined by the capacitance C of the capacitor placed between the electrically conductive component, such as the fixation entrance guide 18, and the ground, resistance R of the resistor placed between the electrically conductive component and ground, and length of time T of sheet intervals. In order to keep an image forming operation uniform in terms of control throughout the operation, it has to be ensured that the capacitor is satisfactorily discharged even when the sheet intervals are shortest. That is, it is desired that an equation ($R \times C \leq 20 \times Tm$), in which Tm stands for the shortest sheet interval in terms of time), is satisfied. In this case, the resistance of the resistor, and the capacitance of the capacitor, are affected by the sheet interval time. Therefore, it is necessary to balance image defects such as transfer void and AC banding. However, this embodiment can keep constant the amount by which current escape to the capacitor, making it easier to keep the image forming apparatus uniform in image quality throughout an image forming apparatus, even if it becomes necessary to reduce sheet interval time.

Further, in the case of the above-described embodiments, it was explained that the occurrence of AC banding images is attributable to the AC voltage applied to the heater of the fixing device. However, the present invention is also applicable to any fixation unit with the same effects, as long as the fixing unit employs a heat source which uses AC voltage as its power source, and therefore, the AC voltage from the power source applies to a sheet of the recording medium.

TABLE 2

| Capacitance (C) pF | Resistance (R) MΩ | R × C | Transfer property difference depending on the No. of processed sheets during continuous printing Interval between sheets 0.05 sec (12 mm) | 0.1 sec (23 mm) | 0.2 sec (46 mm) | 0.3 sec (69 mm) |
|---|---|---|---|---|---|---|
| 4700 | 20 | 0.09 | G | G | G | G |
| | 60 | 0.28 | G | G | G | G |
| | 100 | 0.47 | G | G | G | G |
| 10000 | 20 | 0.2 | G | G | G | G |
| | 60 | 0.6 | G | G | G | G |
| | 100 | 1.0 | G | G | G | G |
| 20000 | 20 | 0.4 | G | G | G | G |
| | 60 | 1.2 | NG | G | G | G |
| | 100 | 2.0 | NG | G | G | G |
| 33000 | 20 | 0.66 | G | G | G | G |
| | 60 | 1.98 | NG | G | G | G |
| | 100 | 3.3 | NG | NG | G | G |
| 47000 | 20 | 0.94 | G | G | G | G |
| | 40 | 1.88 | NG | G | G | G |
| | 60 | 2.82 | NG | NG | G | G |
| | 100 | 4.7 | NG | NG | NG | G |
| 100000 | 20 | 2.0 | NG | G | G | G |
| | 60 | 6.0 | NG | NG | NG | G |
| | 100 | 10.0 | NG | NG | NG | NG |
| 200000 | 20 | 4.0 | NG | NG | G | G |
| | 60 | 12.0 | NG | NG | NG | NG |
| | 100 | 20.0 | NG | NG | NG | NG |
| 330000 | 20 | 6.6 | NG | NG | NG | NG |
| | 60 | 19.8 | NG | NG | NG | NG |
| | 100 | 33.0 | NG | NG | NG | NG |

[Miscellanies]

In the foregoing, the present invention was described with reference to concrete embodiments of the present invention. However, the preceding embodiments are not intended to limit the present invention in scope.

Further, in the preceding embodiments, the pre-transfer guide, fixation entrance guide, or fixation exit roller were used as the electrically conductive component with which a sheet of the recording medium comes into contact while the sheet P remains pinched by both the fixation nip and transfer nip at the same time. However, this electrically conductive component may be in any form to obtain the same effects as those in the preceding embodiments, as long as it comes into contact with the sheet P while the sheet P remains pinched by both the fixation nip and transfer nip at the same time. That is, with the employment of an electrically conductive component having a function of guiding a sheet of the recording medium, and/or conveying the sheet P, it is easy to realize a fixation unit which is inexpensive and simple in structure, by providing the fixation unit with an electrically conductive component dedicated to electrical discharge. However, in order for an electrically conductive component to be able to provide the same effects as those in the preceding embodiments, it is not mandatory for the electrically conductive component to have the function of guiding and/or conveying a sheet of the recording medium. That is, an electrically conductive component which does not have the function of the guiding component or conveying component which guides or convey a sheet of the recording medium may be provided in addition to, or in place of, the pre-transfer guide, fixation entrance guide, and fixation exit roller in the above described preceding embodiments.

Further, the preceding embodiments were described with reference to a case where the effects of the AC voltage transmitted to the transfer nip formed by the photosensitive component as an image bearing component, and transferring component, from the fixation nip, is suppressed. However, these embodiments are not intended to limit the present invention in scope. That is, the present invention is also equally applicable to suppress the effects of the AC voltage transmitted from the fixation nip to the transfer nip formed by the intermediary transferring component as an image bearing component, and a transferring component. That is, in the case of an image forming apparatus of the so-called intermediary transfer type, which is structured so that a toner image formed on its photosensitive component as the first image bearing component is transferred (primary transfer) onto its intermediary transferring component as the second image bearing component, and then, the toner image is transferred from the intermediary transferring component onto a sheet of the recording medium, secondary transfer voltage is applied to the secondary transferring component which forms the transfer nip (secondary transfer nip) by being placed in contact with the intermediary transferring component, in order to transfer (secondary transfer) the toner image onto the sheet P. In this case, it is concerned that the AC voltage applied to the fixing device will affect the secondary transfer voltage in the secondary transfer nip, which may result in image defects such as nonuniformity in density. Therefore, regarding the positioning of an electrically conductive component, and the connection of a capacitor and a resistor, the occurrence of image defects such as those described above can be prevented by reading the transfer nip in the preceding embodiment as the secondary transfer nip, and applying practically the same structural arrangements as those in the preceding embodiments to the secondary transfer nip instead of the transfer nip.

Further, the present invention is intended to solve the problems related to both monochromatic and color image forming apparatuses. That is, the present invention is applicable to not only a monochromatic image forming apparatus, but also, a color image forming apparatus, with the same results.

The application of the present invention is not limited to an image forming apparatus, the transfer unit of which employs a transferring component which is the form of a roller. That is, the present invention is also applicable to an image forming apparatus, the transfer unit of which employs a transferring component other than a transferring component which is in the form of a roller. For example, the present invention is also applicable to an image forming apparatus, the transfer unit of which employ a transferring component which is in the form of a brush or a blade.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 195823/2013 and 159898/2014 filed Sep. 20, 2013 and Aug. 5, 2014, respectively, which are hereby incorporated by reference.

What is claimed is:

1. An image forming apparatus comprising:

an image bearing member configured to carry a toner image;

a transfer unit configured to nip a recording material by a transfer nip formed with said image bearing member and to transfer the toner image from said image bearing member onto the recording material;

a fixing unit configured to nip the recording material by a fixing nip and to fix the toner image on the recording material by heating the recording material using an AC voltage applied thereto;

a voltage source portion configured to apply an AC voltage to said fixing unit;

an electroconductive member contactable to the recording material;

a resistance element connected with said electroconductive member; and a capacitor element connected with said electroconductive member, wherein said electroconductive member is disposed at a position separated from said fixing unit and contactable to the recording material nipped simultaneously by said transfer nip and said fixing nip, and said resistance element and said capacitor element are connected in parallel between said electroconductive member and a ground potential.

2. An apparatus according to claim 1, wherein said electroconductive member is disposed upstream of said fixing nip and downstream of said transfer nip with respect to a feeding direction of the recording material.

3. An apparatus according to claim 2, wherein said electroconductive member guides the recording material fed from said transfer nip to said fixing nip.

4. An apparatus according to claim 1, wherein said electroconductive member is disposed upstream of said transfer nip with respect to the feeding direction of the recording material.

5. An apparatus according to claim 4, wherein said electroconductive member guides the recording material fed to said transfer nip.

6. An apparatus according to claim 5, wherein said electroconductive member includes a first guide portion contactable with a front side of the recording material and a second guide portion contactable with a back side of the recording material.

7. An apparatus according to claim 1, wherein said electroconductive member is disposed downstream of said fixing nip with respect to a feeding direction of the recording material.

8. An apparatus according to claim 7, wherein said electroconductive member feeds the recording material having passed through said fixing nip.

9. An apparatus according to claim 1, wherein said fixing unit includes a heating source configured to generate heat by being supplied with the AC voltage.

10. An apparatus according to claim 1, wherein said transfer unit is supplied with a DC voltage.

11. An apparatus according to claim 9, wherein said heating source includes a heat generating resistor coated with glass, and capacitance of said capacitor element is larger than the electrical capacitance of said heat generating resistor.

12. An apparatus according to claim 1, wherein time Tm between adjacent recording materials fed for continuous image forming operation, a resistance value R of said resistance element and a capacitance C of said capacitor element satisfy, $$R \times C \leq 20 \times Tm.$$

* * * * *